US005421577A

United States Patent [19]

Kobayashi

[11] Patent Number: 5,421,577

[45] Date of Patent: Jun. 6, 1995

[54] METALLIC GOLF CLUBHEAD

[76] Inventor: Kenji Kobayashi, 1845, Ohaza-Higashiohta, Tsubame-shi, Niigata-ken, Japan

[21] Appl. No.: 228,298

[22] Filed: Apr. 15, 1994

[30] Foreign Application Priority Data

Apr. 16, 1993 [JP] Japan ..... 5-090087
Apr. 15, 1994 [JP] Japan ..... 5-088861

[51] Int. Cl.[6] ..... A63B 53/04
[52] U.S. Cl. ..... 273/171; 273/167 H
[58] Field of Search ..... 273/167 R, 167 A, 167 F, 273/167 H, 168, 169, 170, 171, 172, 173, 174, 193 R, 194 R, 194 B

[56] References Cited

U.S. PATENT DOCUMENTS

| | | | |
|---|---|---|---|
| 2,002,108 | 5/1935 | Child | 273/171 |
| 2,171,383 | 8/1939 | Wettlaufer | 273/171 |
| 2,214,356 | 9/1940 | Wettlaufer | 273/171 |
| 3,637,218 | 1/1972 | Carlino | 273/167 H |
| 4,519,612 | 5/1985 | Tsao | 273/171 |
| 4,602,787 | 7/1986 | Sugioka | 273/172 |
| 4,811,950 | 3/1989 | Kobayashi | 273/172 |
| 4,834,387 | 5/1989 | Waites | 273/164.1 |
| 4,867,458 | 9/1989 | Sumikawa | 273/167 H |
| 4,869,507 | 9/1989 | Sahm | 273/171 |
| 4,884,812 | 12/1989 | Nagasaki | 273/167 H |
| 5,056,705 | 10/1991 | Wakita | 273/167 H |

FOREIGN PATENT DOCUMENTS

| | | |
|---|---|---|
| 60-6074 | 2/1985 | Japan . |
| 63-154186 | 6/1988 | Japan . |

*Primary Examiner*—Sebastiano Passaniti
*Attorney, Agent, or Firm*—Quarles & Brady

[57] ABSTRACT

A metallic golf club head of which the center of gravity is kept a large distance off from a face to enlarge a sweet area, which also enables players to hit balls more easily upward. In one embodiment, a back crust of the head body made of pure titanium or titanium alloy is formed with a window aperture, into which is secured a weight made of beryllium copper alloy. In another embodiment, a weight is secured onto a sole by vises with a large specific gravity. According to the invention, the center of gravity of head body is capable of being positioned as backward and low as possible, so that the distance between the face and the center of gravity can be elongated, making it easier to hit balls upward.

12 Claims, 5 Drawing Sheets

METALLIC GOLF CLUBHEAD

BACKGROUND OF THE INVENTION (a) Field of the Invention

The present invention relates to a metallic golf club head of so-called "iron golf club head", especially relates to hollow iron club heads from 1st to 6th iron.

(b) Description of Prior Art

One of the representative of this kind of golf club head is disclosed in Japanese Patent Laid-Open No. 60-36074, in which metal plates are press worked so that face member, upper member and side-peripheral member are formed of metallic crusts respectively, which are integrally combined so as to form a hollow head. Further, another representative is disclosed in Japanese Patent Laid-Open No. 63-154186, wherein metallic plates are press worked so that face member, upper member and upper half of side-peripheral member, and sole member and lower half of side-peripheral member are formed of metallic crusts respectively, thereby forming a hollow club head by integrally combining those metallic crusts.

Although the above-mentioned prior art mainly relate to so-called "metal wood", hollow "metal iron" have come to be utilized for iron golf club head from 1st to 6th in recent years, because such hollow metal irons have such large volume or capacity that players can get a sense of stability in hitting balls.

Whereas, it is imperative that the center of gravity of golf club heads be kept off the face, and that be lowered as close to the sole as possible to obtain the aforesaid sense of stability and enlarge so-called sweet area. To effect which, for example, the upper crust of the head is generally formed thinner, while the lower and back crust thereof is formed thicker in order that the center of gravity of the head may be positioned further backward and low. However, such method or means have had certain limitations for further desirable positioning of the center of gravity of the head.

SUMMARY OF THE INVENTION

It is, therefore, an object of the present invention to provide a metallic golf club head, of which the center of gravity can be positioned as far from the face as possible, positioning the same as low as possible.

It is another object of the present invention to provide a metallic golf club head which enables the easier upward-hitting of golf balls.

According to a major feature of the present invention, a golf club head comprises: a head body; a back crust disposed behind a face of the head body with a hollow portion being intervened therebetween; a window aperture provided in the back crust; a weight to be fitted into the window aperture by means of caulking, said weight being formed of metallic material of which the specific gravity is larger than that of the head body.

BRIEF DESCRIPTION OF THE DRAWINGS

Other objects, features and advantages of the invention will be apparent to those skilled in the art from the following description of the preferred embodiments of the invention, wherein reference is made to the accompanying drawings, of which.

DETAILED DESCRIPTION OF THE PREFERRED EMBODIMENTS

Figure 1:
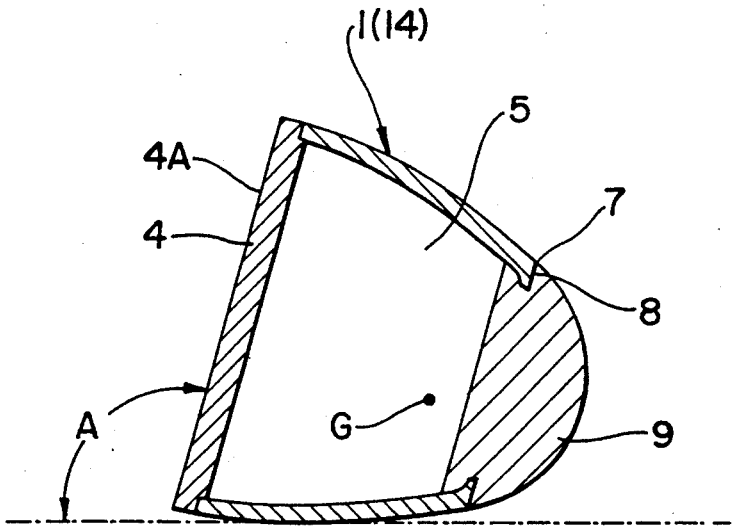
FIG. 1 is a longitudinal section showing a first embodiment of the invention.
Figure 2:
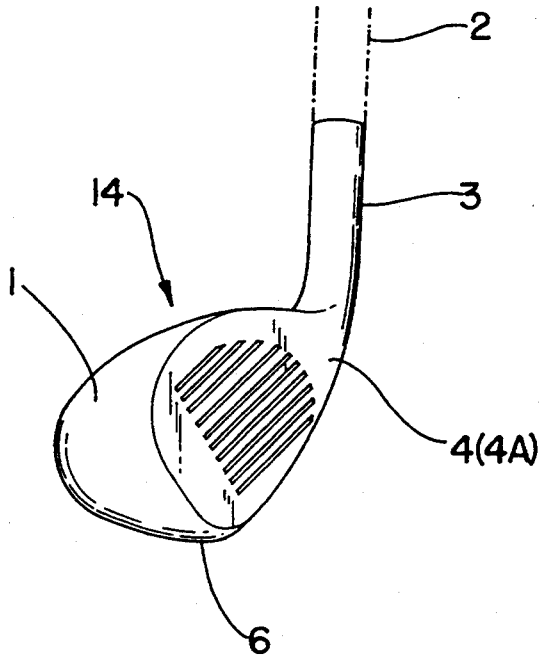
FIG. 2 is a perspective view showing a first embodiment of the invention.
Figure 3:
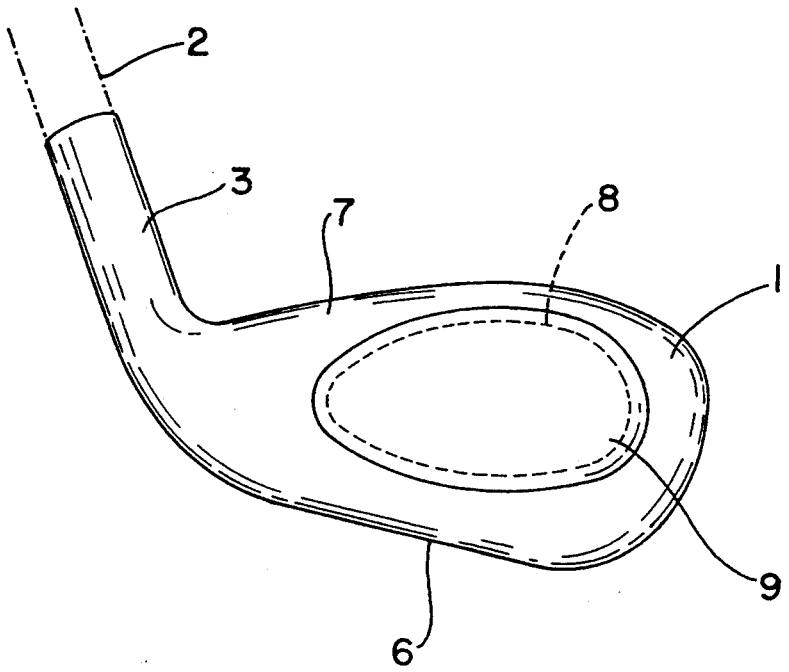
FIG. 3 is a rear view showing a first embodiment of the present invention.

In FIGS. 1 to 4 showing a first embodiment of the present invention, head body 1 comprises face member 4 integrated at its one side with neck 3 for mounting shaft 2 thereto; back crust 7 covering the back of the face member 4 with a hollow portion 5 intervened, having sole portion 6. At the front surface of said face member 4 is formed face 4A. Said head body 1 is Cast of pure titanium (the specific gravity: nearly 4.5) or titanium alloy, while said back crust 7 is cast of the same material or formed by press working of metal plates, thus the edge of said back crust 7 is welded to the edge of said face member 4 so that a predetermined face angle A may be provided. Incidentally, the section of said hollow portion 5 is of semi-eliptic configuration, the volume of which may be 45 to 65 cubic centimeters, preferably nearly 53 cubic centimeters.

Figure 4:
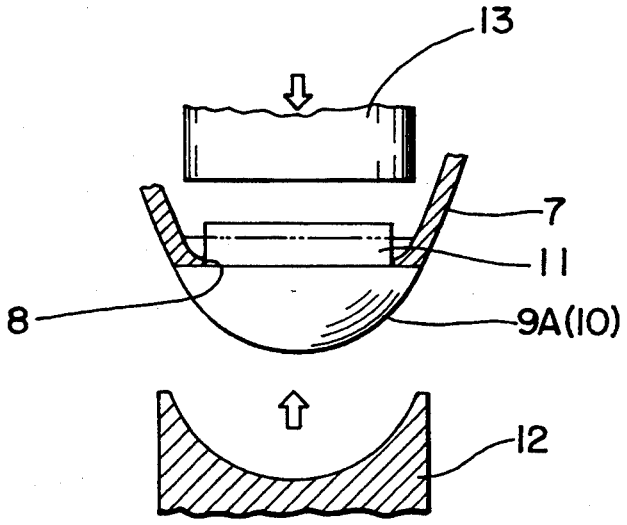
FIG. 4 is a section illustrating a caulking of a metallic golf club head of a first embodiment of the invention.
Figure 5:
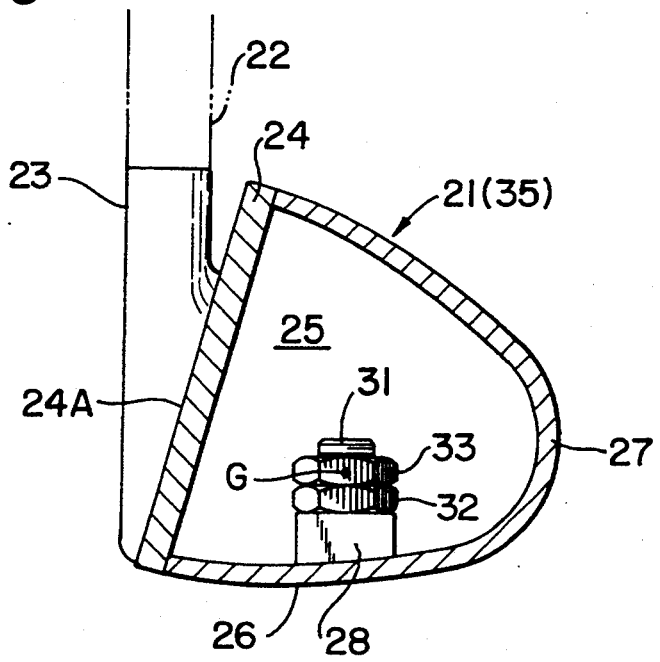
FIG. 5 is a longitudinal section showing a second embodiment of the present invention.
Figure 6:
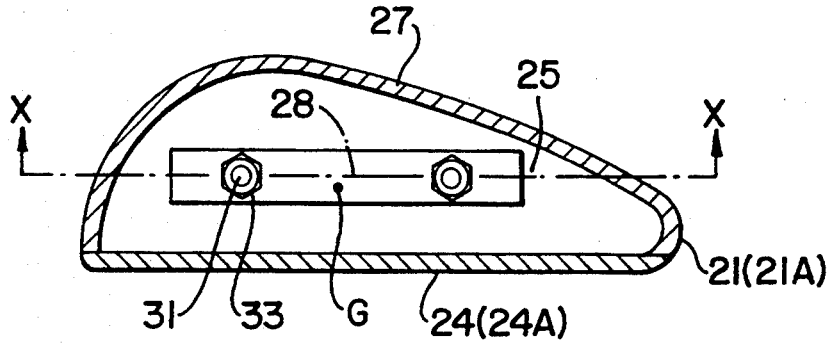
FIG. 6 is a plane cross-section showing a second embodiment of the invention.
Figure 7:
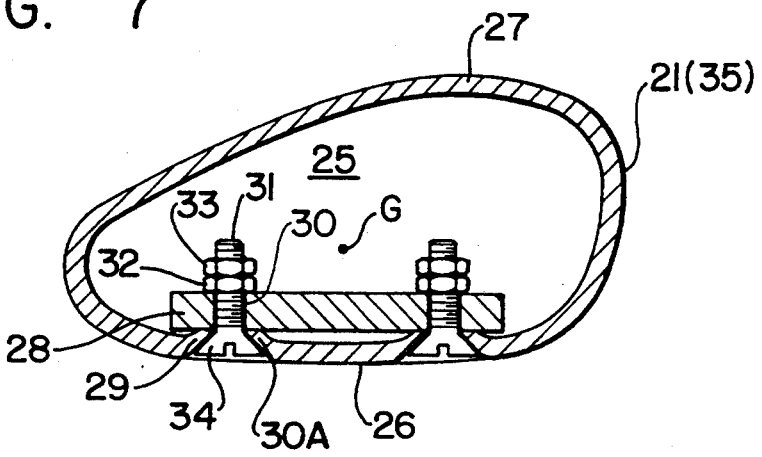
FIG. 7 is a section showing a second embodiment of the invention taken on X—X line of FIG. 6
Figure 8:
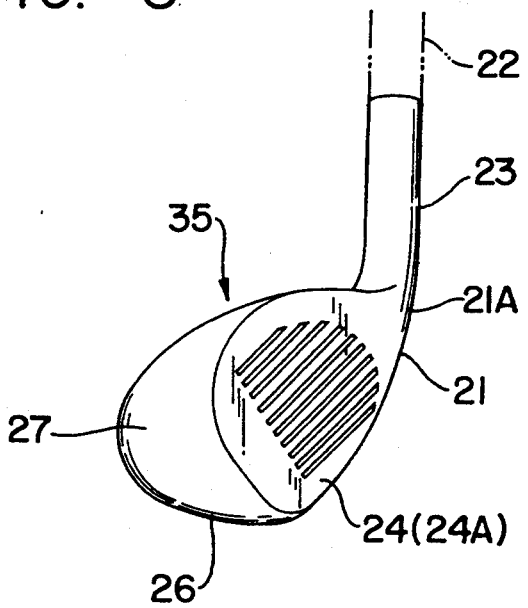
FIG. 8 is a perspective view showing a second embodiment of the invention.

In a slightly lower portion of the back of said back crust 7 is formed transversely-elongated window aperture 8, into which is fitted and secured weight 9 by caulking. Said weight 9 is made of beryllium copper alloy (the specific gravity: nearly 9). As shown in FIG. 4, weight body 9A integrated with protrusion 11 within spherical surface 10 is inserted into said window aperture 8, while said back crust 7 is set in lower die 12 of a press device. Thereafter, upper die 13 is depressed thereto so that said protrusion 11 is crushed and caulked for securing weight 9 thereto. After that, to the edge of said face member 4 is welded the edge of said back crust 7.

The weight rate of said weight 9 to whole head body 14 is approximately less than one-half, preferably within a range of $\frac{1}{2}$ to $\frac{1}{3}$, and most preferably approximately 5/12. And the whole weight and bulk of each golf club head 14 is provided corresponding to the number of the golf club head.

With the structure of head 14 thus far made, the center of gravity G of golf club head is capable of being positioned as backward and low as possible, thereby elongating the distance between face 4A and the center of gravity G, so that sweet area can be extremely enlarged. Furthermore, as the back portion of said weight 9 is exposed outside, the center of gravity of said weight 9 itself (not shown) can be also positioned backward, so that the center of gravity G of golf club head 14 can be still backward. Moreover, said weight 9 is secured into said window aperture 8 by caulking, thus said weight body 9A is capable of being firmly secured to head body 1, which enables players to safely use the golf club head without any fear of the breaking off of said weight 9. Incidentally, the present embodiment should not be limited to the aforementioned embodiment, but may be modified within a scope of the invention. For example, said head body may be formed into a hollow integral construction or one-piece crust, or be formed of three-piece crusts to be integrally combined. Further, metallic material should not be limited to those shown in the embodiment, but other metallic material can be combined.

In FIGS. 5 to 8 showing a second embodiment of the invention, there is provided head body 21 comprising: face member 24 integrated at its one side with neck 23 for mounting shaft 22 thereto; thin-tabular back crust 27 covering the back of the face member 24 with a hollow portion 25 sealed therein, having sole portion 26. At the front surface of said face member 24 is formed face 24A. Said head body 21 is cast of pure titanium (the specific gravity: nearly 4.5) or titanium alloy, while said back crust 27 is cast of the same material or formed by press working of metal plates, thus the edge of said back crust 27 is welded to the edge of said face member 24 so that a predetermined face angle A may be provided. Incidentally, the section of said hollow portion 25 is of semi-eliptic configuration, the volume of which may be 50 to 70 cubic centimeters, preferably nearly 60 cubic centimeters.

Weight 28 is secured to a back portion on said sole 26 within said hollow portion 25. Said weight 28 is made of a transversely elongated and tabular member, which is composed of brass, copper, beryllium copper alloy, copper alloy or the like of 3 to 15 mm thickness, so that the longitudinal length thereof is disposed from heel 21A side along face member 24. Said weight 28 is formed at both ends with through holes 29 for female screws by means of tap, thus each vis 31 is inserted into through holes 30 formed on said sole 26 in order to allow the same to penetrate through said through holes 29. Thereafter, vertically paired nuts 32,33 are screwed from the tip of said each vis 31 made of titanium or titanium alloy so as to secure said weight 28 to said sole 26.

Each inner edge 30A of said through hole 30 protrudes slightly upward in order that head portion 34 of said vis 31 may be located on the same plane relative to the lower surface of said sole 26. Thus, said head portion 34 is welded to sole 26.

The weight rate of said weight 28 to whole head body 35 is approximately less than one-half, preferably within a range of ⅓ to 5/12, most preferably approximately 5/12. "G" designates the center of gravity of head 35, whose weights and bulks are provided corresponding to the number of the golf club head.

Incidentally, said metallic golf club head is fabricated according to the following process:

First, onto said sole 26 of back crust 27 is secured said weight 28 by means of said vis 31 and nuts 32,33. Secondly, to the edge of face member 24 is welded the edge of said back crust 27 in order to integrally fabricate head 35.

With the structure thus made, the center of gravity G of head 35 can be positioned as low as possible within said head 35 which enables players to hit balls more easily upward, In addition, the center of gravity G of head 35 can be kept a large distance off from face 24A, so that so called sweet area can be enlarged. Further, as said weight 28 is fixed to sole 26 by means of vis 31, said weight 28 can be easily secured thereto. And in fabrication of golf club head, weight 28 having desirable weight can be secured, corresponding to the number of each head 35 or players' skill. Furthermore, as said through holes 30 are formed with the upward protrusion in the inner edge 30A thereof, head portion 34 of said vis 31 can be evenly disposed with respect to the lower surface of said sole 26.

Figure 9:
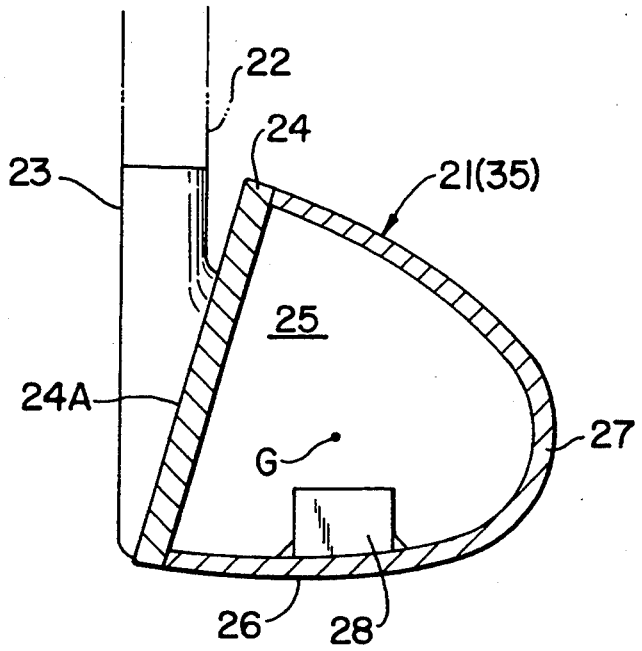
FIG. 9 is a longitudinal section showing a third embodiment of the invention.
Figure 10:
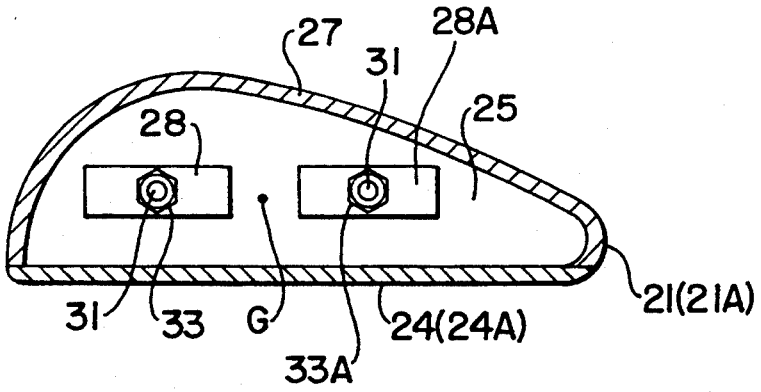
FIG. 10 is a plane cross-section showing a fourth embodiment of the invention.

In FIGS. 9 to 10 showing third and fourth embodiments of the invention, the same portions as those described in the second embodiment will be designated at the same reference numerals, and their repeated detailed description will be omitted.

In a third embodiment, weight 28 is secured to sole 26 of head body 21 by means of bonding or brazing. Accordingly, the center of gravity G can be positioned as low as possible within head 35, and that balls can be hit upward more easily as well. Further, the center of gravity G of head 35 can be kept a large distance off from face 24A, so that sweet area is able to be enlarged as well.

In a fourth embodiment, two weights 28, 28A are disposed on sole 26, which are secured thereto by means of vis 31 and nuts 33, 33A. With the structure thus made, the weight distribution of head 21 can be provided to be nearly symmetrical at both lateral sides, consequently, a sense of unsteadiness in hitting balls can be reduced.

Incidentally, the present invention should not be limited to the aforementioned embodiments, but may be modified within a scope of the invention. For example, said head body may be formed into a hollow integral construction or one-piece crust, or be formed of three-piece crusts to be integrally combined. Further, metallic material should not be limited to those shown in the embodiments, but other metallic material can be combined. In addition, volts/nuts may be used instead of said vis, and three or more weights may be provided on sole. Furthermore, the diameters of said through holes may be formed slightly larger than those of vises so that the vises may be loosely inserted therein, thereby enabling the adjustment of mounting positions of said weights.

What is claimed:

1. A metallic golf club head comprising:

a head body having a hollow portion therein, said hollow portion having a volume of 45 to 65 cc;

a window aperture provided in a back crust of the head body; and a weight secured into the window aperture by caulking, said weight being formed of metallic materials of which the specific gravity is larger than that of the head body.

2. A metallic golf club head according to claim 1, wherein said head body is made of pure titanium or titanium alloy, while said weight is made of beryllium copper alloy, a ratio of the weight to the head body being from 1:3 to 1:2 by weight.

3. A hollow metallic golf club head comprising:

a head body consisting of a back crust and a face crust, said back crust having a sole;

a hollow interior defined by the back and face crust, said hollow interior having a 50 to 70 cc volume;

a weight secured onto said sole, a ratio of the weight to the head body being from 1:3 to 5:12 by weight.

4. A hollow metallic golf club head according to claim 3, wherein said weight is secured onto said sole by means of screws penetrating through through-holes formed in said sole, said through-holes having inner edges protruding upward within said hollow interior.

5. A hollow metallic golf club head according to claim 3, wherein said weight is secured onto said sole by means of bolts and nuts, said bolts and nuts penetrating through through-holes formed in said sole.

6. A hollow metallic golf club head according to claim 3, wherein said weight is secured onto said sole by bonding.

7. A hollow metallic golf club head according to claim 3, wherein two or more weights are provided instead of said weight.

8. A metallic golf club head according to claim 1, wherein said head body is composed of a face member and a back crust.

9. A hollow metallic golf club head according to claim 4, wherein two or more weights are provided instead of said weight.

10. A hollow metallic golf club head according to claim 5, wherein two or more weights are provided instead of said weight.

11. A hollow metallic golf club head according to claim 6, wherein two or more weights are provided instead of said weight.

12. A metallic golf club head according to claim 3, wherein said head body is composed of a face member and a back crust.

* * * * *